US007410456B2

(12) United States Patent
Wase

(10) Patent No.: US 7,410,456 B2
(45) Date of Patent: Aug. 12, 2008

(54) METHOD OF PURIFYING CONTAMINATED OIL IN A CENTRIFUGAL SEPARATOR USING A SEPARATION AID AND STARTING LIQUID

(75) Inventor: Claes Wase, Tullinge (SE)

(73) Assignee: Alfa Laval Corporate AB, Lund (SE)

( * ) Notice: Subject to any disclaimer, the term of this patent is extended or adjusted under 35 U.S.C. 154(b) by 419 days.

(21) Appl. No.: 10/538,295

(22) PCT Filed: Dec. 10, 2003

(86) PCT No.: PCT/SE03/01925

§ 371 (c)(1),
(2), (4) Date: Dec. 14, 2005

(87) PCT Pub. No.: WO2004/053035

PCT Pub. Date: Jun. 24, 2004

(65) Prior Publication Data

US 2006/0217254 A1 Sep. 28, 2006

(30) Foreign Application Priority Data

Dec. 12, 2002 (SE) ..... 0203699

(51) Int. Cl.
*B04B 11/00* (2006.01)

(52) U.S. Cl. ..... 494/37; 494/27; 494/901

(58) Field of Classification Search ..... 494/24, 494/36, 37, 43, 49, 64, 65, 67, 83, 84, 901, 494/27–30, 68–73; 210/168, 171, 232, 360.1, 210/416.5; 184/6.24
See application file for complete search history.

(56) References Cited

U.S. PATENT DOCUMENTS

| | | | | |
|---|---|---|---|---|
| 3,960,319 | A * | 6/1976 | Brown et al. | 494/27 |
| 4,710,159 | A | 12/1987 | Gullers | |
| 4,820,256 | A | 4/1989 | Nordstrom | |
| 6,953,423 | B2 * | 10/2005 | Maehens | 494/30 |
| 2006/0217254 | A1 * | 9/2006 | Wase | 494/37 |

FOREIGN PATENT DOCUMENTS

| | | |
|---|---|---|
| WO | WO 95/14752 | 6/1995 |

* cited by examiner

*Primary Examiner*—Charles E Cooley
(74) *Attorney, Agent, or Firm*—Michaud-Duffy Group LLP

(57) ABSTRACT

In a centrifugal separator the liquid separation aid attracts/binds contaminating particles in oil supplied to a separation chamber. Purified oil is discharged through a central light phase outlet of the separation chamber, the liquid separation aid and separated particles are discharged through a heavy phase outlet. Purification is carried through using a starting liquid, supplied to the separation chamber to form a layer that creates a liquid seal in the centrifugal rotor, covering said heavy phase outlet. Contaminated oil and liquid separation aid are supplied to the separation chamber. While purified oil leaves the separation chamber through the light phase outlet, at starting liquid and liquid separation aid together with particles are discharged through the heavy phase outlet.

7 Claims, 1 Drawing Sheet

METHOD OF PURIFYING CONTAMINATED OIL IN A CENTRIFUGAL SEPARATOR USING A SEPARATION AID AND STARTING LIQUID

FIELD OF THE INVENTION

The present invention relates to a method of purifying contaminated oil from particles suspended in the oil by means of a liquid separation aid, which has a density larger than that of the oil. The separation aid is dispersed in the contaminated oil in order to make the particles more easily separable from the oil. The contaminated oil and the liquid separation aid are supplied into a separation chamber of a rotating centrifugal rotor. The liquid separation aid and the particles are separated from the oil by centrifugal force. The purified oil is discharged from the separation chamber through a central light phase outlet. The separated particles and the liquid separation aid are discharged from the separation chamber through a heavy phase outlet situated radially outside of the light phase outlet.

BACKGROUND OF THE INVENTION

Mineral oils (also half- and full-synthetic) as well as animal oils and vegetable oils, with or without additives, are used widely in industry for various purposes, such as lubrication, cooling and insulation. During such use the oils commonly become contaminated by different kinds of particles. Depending on the composition and the particular use different methods for regeneration of contaminated oils are used.

Historically, contaminated oils have been filtered in filter beds containing clay, bleaching earth or kieselguhr.

Purification of mineral oils from suspended particles is described for example in U.S. Pat. No. 4,094,770. According to this patent the particles that are not filtrated away are removed by addition of an agglomerating aid in the form of a mixture of acetone and 2-butanone. The agglomerated particles settle and may be removed from the oil. A finishing distillation step is necessary in order to purify the oil from the agglomerating aid.

U.S. Pat. No. 4,491,515 describes purification of lubricating oil which has been used in vehicles. The oil, which may contain many kinds of contaminants, is purified by addition of a compound containing a carbonyl group (ketone) mixed with a water-containing electrolyte, for example an inorganic or organic acid. When this acid has been added to the oil, there is relatively rapidly obtained an agglomeration of particulate contaminants that may be removed by settling or centrifugation. The ketone is recovered in a distillation step.

U.S. Pat. No. 4,519,899 describes purification of rolling oil which has been contaminated with particles of the material which has been treated at the rolling operation. A coagulating agent, as for example a water-containing soda solution, is mixed with the oil in a carefully controlled amount. The particles coagulate and are found in the water phase, which may be removed by settling or in a centrifugal separator.

In SE 512 750 there is described a method for gravimetric separation of an oil which is contaminated with particles and/or water. According to this method a collection polymer or polymer mixture, which is not soluble in oil, is added to the contaminated oil and mixed with the same, after which separation of the oil and the collection polymer occurs. The collection polymer and the main part of the contaminants form a bottom phase, while the oil forms a top phase. The bottom phase with the collection polymer and the contaminants is removed. According to this publication the separation may take place by centrifugation.

The contaminants in the shape of particles, which are to be removed from the oil, may in many cases be very small and difficult to remove from the oil. The amount of particles may also be small. The amount of separating aid that must be added may therefore be comparatively small. To separate two liquid phases of different density from each other in a centrifugal separator may cause problem if one of the phases is present only in a small amount.

SUMMARY OF THE INVENTION

According to the invention, in use of a method as initially defined, the separation chamber of the centrifugal rotor is pre-charged with a starting liquid, which is heavier than the oil and insoluble therein, in an amount such that a layer of the starting liquid forms a liquid seal in the centrifugal rotor, covering said heavy phase outlet. Only after such pre-charging of the separation chamber the contaminated oil and the liquid separation aid are supplied to the separation chamber, at least part of the starting liquid together with liquid separation aid and particles, separated from the oil, being discharged from the separation chamber through said heavy phase outlet.

The invention may with advantage be carried through in such a manner that an amount of the liquid separation aid is used as said starting liquid. In this way only one kind of auxiliary liquid has to be used. On the other hand it may be suitable to use a starting liquid of a different kind to form the liquid seal in order to restrict the amount of liquid separation aid needed. Such a different kind of starting liquid may be water, for instance.

Among the oils, which may be cleaned by the proposed method, there can be mentioned oils used for insulation purpose in transformers and tap changers, rolling oils, hydraulic oils and lubricating oils.

The choice of the liquid separating aid depends on the oil, which is to be purified. The oils mentioned above may be pure mineral oils, half- or full-synthetic oils, or animal or vegetable oils with or without additives giving the oils their desired properties: The choice of separating aid is also dependent on the kind of contaminating particles, which are to be removed from the oil. As may be understood from the prior art mentioned above different combinations of separating aids are available. The liquid separation aid may or may not contain water or be soluble in water. The used separation aid should however be insoluble in oil. Depending on the amount of contaminated particles a larger or smaller amount of separating aid is added.

The separating aid may contain substances causing flocculation of the particles, which gives heavier particles more easily removable by centrifugal separation. The separating aid may also attract or bind the particles by way of chemical or surface chemical bonds.

By filling a radially outer space in the aforementioned rotor with said starting liquid, e.g. liquid separation aid, before oil purification is started, an efficient purification can be obtained immediately. If, instead, contaminated oil mixed with liquid separation aid had been supplied to the rotating rotor from the start, a considerable amount of oil would be discharged through the separation chamber outlet for heavy phase, before a liquid seal covering this outlet had been formed in the rotor by liquid separation aid separated from the contaminated oil.

When the centrifugal rotor contains separation discs improving the separation, an interface level between oil and separation aid is maintained, in a steady state process, in the vicinity of the outer edges of the separation discs.

According to the invention a continuous addition of liquid separation aid takes place together with the oil. The liquid separation aid and the oil may, if so is considered suitable, be mixed in some kind of mixer connected to the inlet of the centrifugal separator or in a separate mixing operation prior to the purification. In the last mentioned case a desired holding time for the mixture of oil and liquid separating aid may be obtained prior to the purification.

The method according to the invention may advantageously be used for purification of mineral or synthetic oils containing additives in order to give the oil the desired properties for the intended application, at which the density of the oils lie in the interval of 0.85-1.05 g/cm$^3$ at 40° C.

The method of the invention may with advantage be used for mineral oils, 20 which have been contaminated with very small particles, for example very small soot particles or metal particles which are floating in the oil and therefore do not settle. Mineral oils have usually a density of 0.85-0.90 g/cm$^3$ at 40° C. Earlier the only possibility to purify oil containing this kind of contaminants have been to use kieselguhr or bleaching clay filters, which filter materials are expensive and create problems in connection with deposition of the used filter beds.

If the mineral oil has been used as an insulating agent in a transformer or tap changer and is free from additives apart from a necessary oxidation inhibitor, the separation aid with advantage may be a liquid polymer, which binds the small soot particles that are present in the oil. Also rolling oil as well as chlorine-paraffin oil contaminated with very small metal par-tides may be cleaned in this way.

The oil to be purified may also be lubricating oil for Diesel engines, contaminated with small dispersed particles, the separation aid being a liquid polymer.

One example of a suitable liquid polymer for purification of these kinds of oils is a polyhydroxy alkoxylate with a density of 1.0-1.1 g/cm$^3$ at 40° C.

EXAMPLE 1

A mineral oil that has been used as an insulating agent in a tap changer and is contaminated with soot particles should be purified from the same. The amount of oil in the tap changer may be 200-1500 litres. For the purification there is used a mobile centrifugal separator MIB303S-13 from Alfa Laval AB. Depending on the time interval between consecutive purification operations the oil contains 1-10% soot. The rotor of the centrifugal separator is started and is brought to rotate at full speed. Separation aid in the form of a liquid polymer is added to the rotor in an amount of 0.71. The polymer is forced to flow to the outer part of the separation chamber of the rotor by centrifugal force, where it forms a liquid layer rotating with the rotor and covets a heavy phase outlet of the separation chamber. The amount of polymer that is needed to form the liquid layer depends on the size and construction of the centrifugal separator. When the layer has been formed the oil that is to be purified is supplied, oil having then already been mixed with polymer. The amount of polymer in the supplied mixture is around 4%. The polymer that is used for the purification consists of a polyhydroxy alkoxylate.

EXAMPLE 2

Rolling oil consisting of a chlorine-paraffin oil shall be purified by the method according to the invention. The oil, which may contain 1-17% sludge, is mixed with liquid polymer, a polyhydroxy alkoxylate. A mobile centrifugal separator of the same kind as used in example 1 is used for the purification. Polymer is added to the centrifugal separator when the separator has been started to form the rotating liquid layer. The amount of oil that is to be purified may be between 3-15 m$^3$. Previously, contaminated oil had to be deposited at extremely high costs. Purification according to the technology now suggested, therefore, has important advantages.

EXAMPLE 3

Lubricating oil used for lubrication of Diesel engines shall be purified according to the invention. The oil contains a number of additives in order to give the oil the desired properties.

The oil is contaminated with 0.1 to 5% of particles mainly consisting of soot, combustion rests and reaction products from some of the additives of the oil. The main part of the contaminants is present as colloidal or sub micron particles, which are impossible to remove in centrifugal separators or filters.

50 litres of the contaminated lubricating oil is mixed by stirring with about 4% liquid polymers, a polyhydroxy alkoxylate. The mixture is heated to a temperature of 95° C. In order to separate the polymer entraining the contaminants use is made of a centrifugal rotor of the same kind as in example 1, which is pre-charged with a polymer layer before the oil/polymer mixture is supplied into it.

The result of the extraction was measured by analysis of the oil prior to and after the purification in respect of insoluble matter in n-pentan (ASTM D 893-892).

The amount of contaminants in the oil had decreased by 82%, from 0.96% to 0.18% insoluble matter.

BRIEF DESCRIPTION OF THE DRAWING

The method according to the invention is further described below with reference to the attached drawing, which shows a centrifugal separator suitable for carrying through the method of the invention.

DETAILED DESCRIPTION OF THE PREFERRED EMBODIMENT

Figure 1:
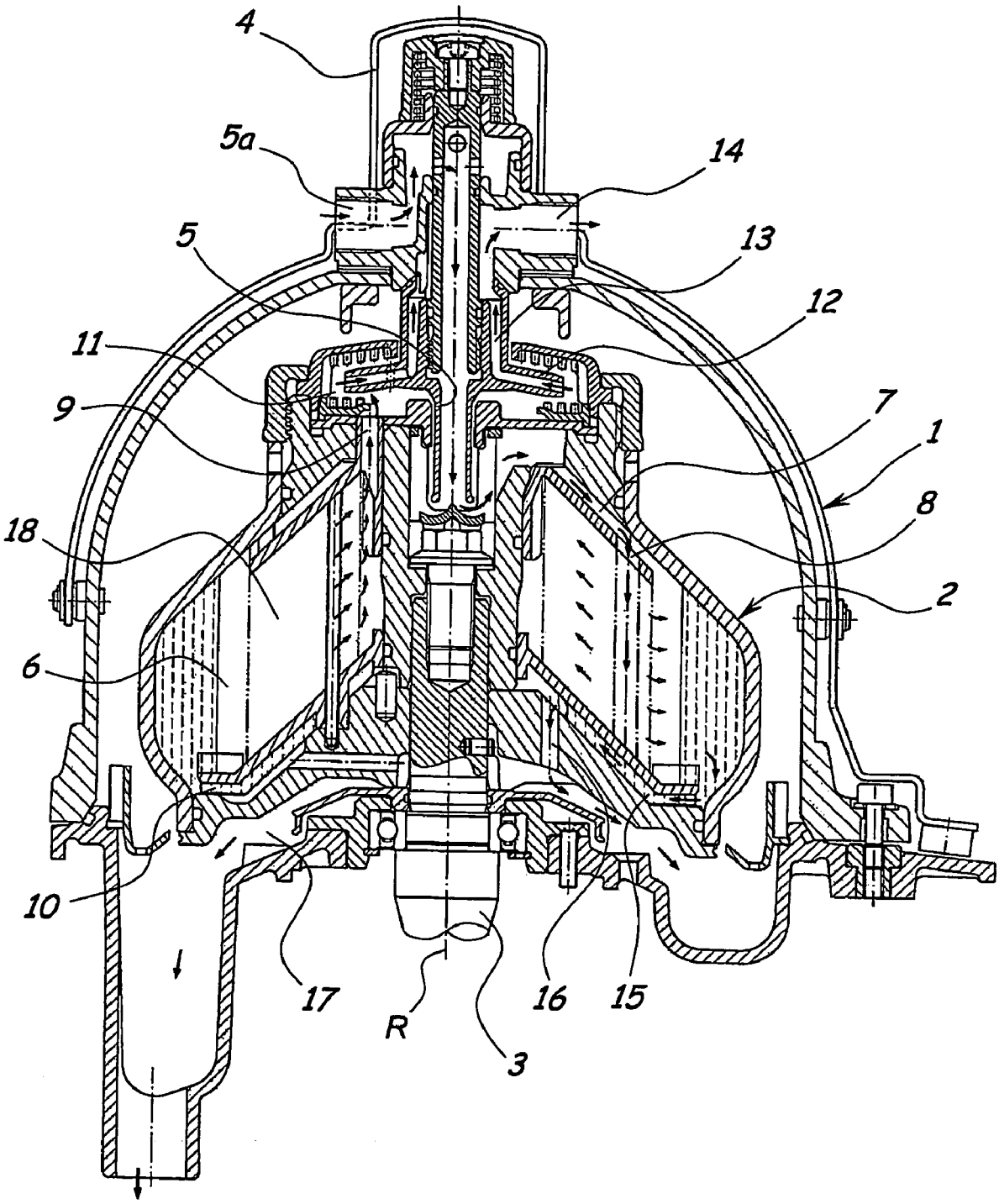

The centrifugal separator shown in the drawing has a stationary housing 1, in which there is arranged a centrifugal rotor 2 rotatable about a vertical centre axis R. The rotor 2 is mounted on top of a vertical driving shaft 3 coupled to a driving device (not shown). A connection device 4 carried by the housing 1 includes, among other things, a vertical inlet pipe 5 extending from above into the rotor 2 and forming an inlet channel that opens into a central inlet space in the rotor. Said inlet channel communicates at its upper end with an inlet 5*a* of the connection device 4.

The rotor 2 forms a separation chamber 6 and several inlet passages 7 leading from said central inlet space in the rotor to respective inlets 8 of the separation chamber 6. The rotor 2 also forms a central light phase outlet 9 of the separation chamber 6 at a relatively small distance from the centre axis R and, at a greater distance from the centre axis R, a number of heavy phase outlets 10 of the separation chamber 6.

The light phase outlet 9 is in the form of an overflow outlet leading to an outlet chamber 11 in the upper part of the rotor 6. In this outlet chamber 11 there is arranged a paring disc 12, which is supported by the connection device 4 and has at least one paring channel 13 communicating with an outlet 14 of the connection device.

The heavy phase outlets 10 of the separation chamber communicate through channels 15 with an overflow outlet 16 of the rotor, opening to a space 17 in the housing 1 below the rotor 2.

Within the separation chamber 6 there is a stack of conical separation discs 18, which are arranged coaxially with the centre axis R and delimit between themselves thin passages for through flow of liquid under treatment in the rotor.

The centrifugal separator in the drawing operates in the following manner when used for cleaning oil from small particles suspended therein by means of a separation aid in liquid form, e.g. a liquid polymer. The separation aid is insoluble in the oil to be cleaned and has a density larger than that of the oil.

Either before or after the rotor has been brought in rotation about the centre axis R, a certain amount of separation aid, or another starting liquid heavier than the oil to be cleaned, is supplied through the rotor inlet into the separation chamber 6. This starting liquid forms, when the rotor is rotating, a liquid layer in the radially outermost part of the separation chamber, covering the heavy phase outlets 10 thereof.

After the separation chamber 6 has been pre-charged with said amount of a starting liquid, a mixture of oil to be cleaned and said liquid separation aid is supplied into the separation chamber at any predetermined rate, preferably continuously. The mixture enters the separation chamber though its inlets 8 and flows axially through aligned distribution holes in the separation discs 18 into the various interspaces between the discs. In these interspaces, or flow paths, the oil part of the mixture flows inwardly towards the centre axis R, whereas the dispersed separation aid, together with particles contaminating the oil, moves outwardly away from the centre axis R.

Oil having been freed from particles and separation aid leaves the separation chamber 6 through its central light phase outlet 9 and flows further on, via the outlet chamber 11 and through the paring disc 12, out through the outlet 14 of the connection device 4. The dispersed separation aid and the particles move out into the aforementioned layer of starting liquid, which may also be liquid separation aid. From the outer part of the separation chamber 6 at least part of the starting liquid, together with separation aid and particles, separated from the oil, leave the separation chamber through its heavy phase outlets 10 and flow further on, via the outlet channels 15, to and out through the overflow outlet 16 of the rotor 2 to the space 17 below the rotor.

At the time when said starting liquid has been supplied into the separation 20 chamber 6, but before any oil to be cleaned has been supplied, the layer of starting liquid forms an inner cylindrical liquid surface at a first radial level in the separation chamber. Then, when oil to be cleaned is supplied, the cylindrical surface of the starting liquid is displaced radially outwardly to a second level. This second level should be situated radially inwardly of the heavy phase outlets 10. Thus, the amount of starting liquid to be supplied must be accurately determined, so that this liquid can form a liquid seal in the rotor during the initial part of the separation process, preventing escape of oil through the outlets 10.

In a steady state separation process there is always an interface layer formed between oil and separation aid having been separated from the oil, said interlace layer being maintained at a level radially inside of the heavy phase outlets 10.

The centrifugal rotor 2 in the drawing has a solid wall surrounding the separation chamber 6. However, it may be desirable sometimes to use, in-stead, a rotor having peripheral sludge outlets adapted to be intermittently openable during operation of the rotor, so that particles separated from the oil but not entrained by the liquid separation aid leaving through the heavy phase outlets 10 can be intermittently discharged during operation of the rotor.

The invention claimed is:

1. A method of purifying contaminated oil from particles suspended there in by means of a liquid separation aid having a density larger than that of the oil and being dispersed in the contaminated oil in order to make the particles more easily separable from the oil, the method comprising supplying said contaminated oil and said liquid separation aid into a separation chamber of a rotating centrifugal rotor, separating in said separation chamber the particles and the liquid separation aid from the oil by centrifugal force, discharging purified oil from the separation chamber through a central light phase outlet thereof and discharging separated particles together with separated liquid separation aid from the separation chamber through a heavy phase outlet of the separation chamber, situated radially outside said central light phase outlet, pre-charging the separation chamber, before supplying a substantial amount of contaminated oil thereinto, with a starting liquid, which is heavier than the oil and insoluble therein, in an amount such that a layer of the starting liquid forms a liquid seal in the centrifugal rotor, covering said heavy phase outlet, supplying thereafter said contaminated oil and said liquid separation aid into the separation chamber, and discharging from the separation chamber through said heavy phase outlet at least part of said starting liquid and particles together with liquid separation aid, separated from the oil.

2. A method according to claim 1, wherein an amount of said liquid separation aid is used as said starting liquid.

3. A method according to claim 1, wherein the oil is a mineral or synthetic oil containing additives giving the oil desired properties for its intended use, the density of the oil being in the interval to about 0.85 to about 1.05 g/cm$^3$ at 40° C.

4. A method according to claim 3, wherein characterized in that the oil is a pure mineral oil having a density of about 0.85 to about 0.90 g/cm$^3$ at 40° C.

5. A method according to claim 4, wherein the mineral oil is one that has been used as an insulating agent in a transformer or tap changer, is free from additives, apart from necessary oxidation inhibitor, and is contaminated with very small soot particles, the separation aid being a liquid polymer.

6. A method according to claim 5, wherein that the polymer is a polyhydroxy alkoxylate having a density of 1.0-1.1 g/cm$^3$ at 40° C.

7. A method according to claim 3, wherein characterized in that the oil is one that has been used as a lubrication oil for Diesel engines and is contaminated with small dispersed particles, the separation aid being a liquid polymer.

* * * * *